US007055357B2

(12) United States Patent
Weschler

(10) Patent No.: US 7,055,357 B2
(45) Date of Patent: Jun. 6, 2006

(54) VEHICLE REPAIR CLAMPS

(76) Inventor: Bradley Weschler, 5 Skylark Ct., South Huntington, NY (US) 11746

( * ) Notice: Subject to any disclaimer, the term of this patent is extended or adjusted under 35 U.S.C. 154(b) by 77 days.

(21) Appl. No.: 10/802,355

(22) Filed: Mar. 17, 2004

(65) Prior Publication Data

US 2005/0204520 A1 Sep. 22, 2005

(51) Int. Cl.
*B21D 11/00* (2006.01)

(52) U.S. Cl. ..... 72/305; 72/308; 72/705

(58) Field of Classification Search ..... 72/305, 72/308, 457, 422, 705; 24/308, 329, 335; 254/133 R; 269/152, 153, 155; 294/92, 294/106, 902

See application file for complete search history.

(56) References Cited

U.S. PATENT DOCUMENTS 1,987,826 A * 1/1935 Heumann ..... 403/73
2,725,917 A 12/1955 Kauppi
3,241,352 A 3/1966 Lincourt
3,744,838 A * 7/1973 Jackson ..... 294/116
3,958,825 A * 5/1976 Diamond ..... 294/82.13
4,248,078 A * 2/1981 Russo ..... 72/457
4,324,125 A 4/1982 Jarman et al.
4,457,159 A 7/1984 Jarman et al.
4,607,829 A * 8/1986 Suska ..... 269/88
4,718,266 A 1/1988 Jarman et al.
4,930,335 A 6/1990 Ishihara
5,267,465 A 12/1993 Gilman
5,943,902 A 8/1999 Ishihara
5,988,616 A * 11/1999 Fuller et al. ..... 269/6
6,260,902 B1 * 7/2001 Synnelius ..... 294/106
6,453,715 B1 * 9/2002 Venalainen ..... 72/308
6,481,257 B1 * 11/2002 Chartier ..... 72/308

* cited by examiner

*Primary Examiner*—Ed Tolan
(74) *Attorney, Agent, or Firm*—Galgano & Burke, LLP

(57) ABSTRACT

Vehicle repair clamps for grasping curved or non-linear surfaces. One embodiment comprises a hinged clamp comprising at least one jaw formed of a plurality of jaw sections that are hingedly connected and that may be adjusted to grasp surfaces of different angles. The clamp segments may be straight or arcuate. These embodiments facilitate attachment of the hinged jaws to portions of a damaged vehicle which form different angles and/or have various radii of curvature. Vehicle repair clamps comprising jaws with non-linear clamping portions.

23 Claims, 9 Drawing Sheets

VEHICLE REPAIR CLAMPS

The present invention relates to clamps used for connecting straightening devices to vehicle frames or uni-bodies. Specifically, the embodiments of the present invention relate to vehicle clamps comprising non-linear and/or hinged clamping portions.

BACKGROUND OF THE INVENTION

When a vehicle has been in an accident, it is common for the frame, in the case of vehicles having a frame, or the unibody to be bent or deformed. It is well known that it is necessary to straighten the portions of the frame or unibody in order to affect an acceptable repair. As used herein in connection with repairing a damaged vehicle, the term "straighten" refers to returning one or more portions of a vehicle closer to its original configuration than the configuration it was in prior to starting the repair. The term "straighten" when used in this context does not necessarily indicate that the portion of the vehicle being repaired is made to be linear.

It is common in the vehicle repair industry to attach a powerful hydraulic straightening device to one or more portions of a vehicle utilizing a clamp which is attached directly to the vehicle and to a chain which connects the clamp to the straightening device. To the best knowledge of the inventor, the jaws of previously known clamps of the prior art have been straight and have also been formed with unitary jaws, i.e., two relatively movable "jaw" pieces which each comprise gripping surface formed of a unitary element. As used herein, the term "jaw" is used to indicate one side of the portion of the clamp which is used to grasp a portion of the vehicle. Thus, it will be understood that a clamp requires at least two jaws which are tightened onto the portion of the vehicle to which force will be exerted by the pulling device. Many portions of a vehicle, to which it would be desirable to apply a force during vehicle repair, are not linear, but rather are formed by the intersection of two portions meeting at an angle or are curved. It would, therefore, be desirable to provide one or more clamps shaped to grasp angled and/or curved portions of a damaged vehicle.

SUMMARY OF THE INVENTION

The present invention is directed to vehicle repair clamps for grasping curved or non-linear surfaces. One embodiment of the present invention comprises a hinged clamp comprising at least one jaw formed of a plurality of jaw sections that are hingedly connected and that may be adjusted to grasp surfaces of different angles. The clamp segments may be straight or arcuate. These embodiments facilitate attachment of the hinged jaws to portions of a damaged vehicle which form different angles and/or have various radii of curvature.

Another aspect of the present invention is directed to vehicle repair clamps comprising jaws with non-linear clamping portions.

DETAILED DESCRIPTION

As noted above, various embodiments of the present invention are designed to facilitate attachment of a straightening device to a portion of a car which is formed on an angle or curve. Embodiments of the present invention are suitable for providing secure attachment to interior angles which are less than 180° or exterior angles which are greater than 180°, as well as to the inside or outside of a curved vehicle portion.

Figure 1:
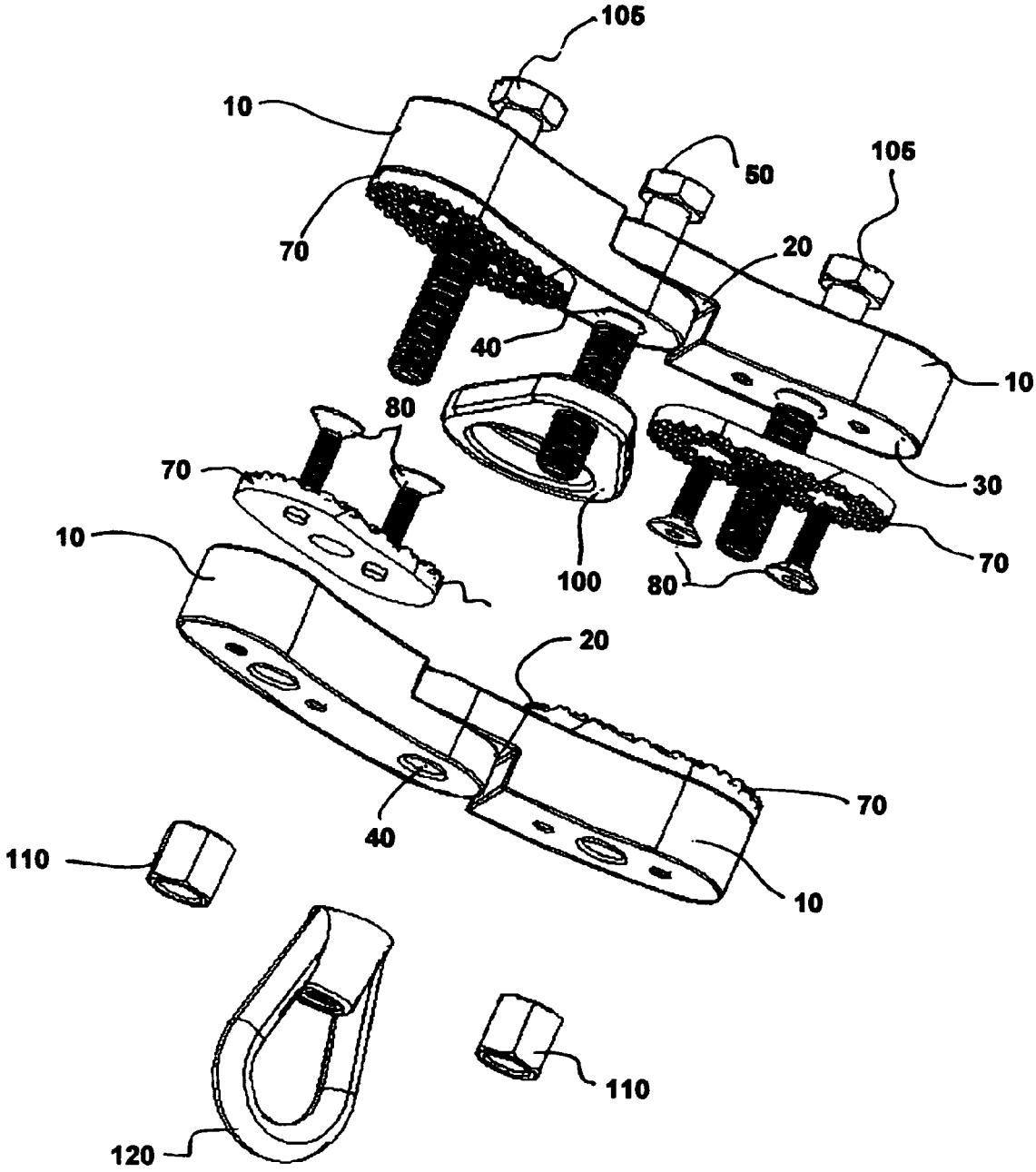
FIG. 1 is a top, exploded view of a hinged clamp having arcuate jaw segments according to one embodiment of the present invention.

According to one embodiment of the present invention shown in FIG. 1, each jaw of a clamp comprises a pair of arcuate jaw segments 10 which are hingedly connected by throughbolt 50 and loop tightener 120. While in this illustrated embodiment, each jaw comprises two jaw segments 10, it is also within the scope of the present invention to utilize a greater number of jaw segments to form a single jaw. It is also within the scope of the present invention to utilize at least one non-linear shaped jaw segment 10 and at least one linear jaw segment in a single jaw.

The illustrated jaw segments advantageously each comprise at least one clamp pad 70 which is selectively secured to each jaw segment 10 by removable fasteners 80. In the illustrated embodiment, fasteners 80 are threaded screws which facilitate the placement of clamp pad 70 when desired. Fasteners 80 are advantageously countersunk into clamp pad 70 so that they will not contact the vehicle portion to which the clamp is attached. Illustrated clamp pads 70 have a knurled surface in order to enhance gripping of the vehicle portion to which attachment is desired. Clamp pads 70 can be formed of any suitable material. It is generally preferred that the material be harder than the material to which it will be attached.

In addition to being hingedly connected by the bolt 50 and loop tightener 120, opposing jaws of this illustrated embodiment are drawn together after positioning on the desired vehicle portion by bolts 105 and nuts 110. From the present description and drawings, those skilled in the art will appreciate that the portion of clamp pad 70 extending from the edge of the clamp pad to bolts 105 is available for gripping a portion of a vehicle. Typically, this distance is preferably about ⅜ inch to about 1 inch, however, greater or lesser gripping areas may be used. Alternatively, other types of gripping surfaces can be provided either on clamp pads or directly on surfaces 30 of the jaw segments 10.

Loop tightener 120 can be hand tightened onto bolt 105. As shown, a ring connector 100 can also be attached to bolt 50 in order to provide a different point or points of attachment for exerting force with a straightening device. According to this preferred embodiment of the present invention, ring connector 100 is attached to bolt 50 and positioned on the desired side of the clamp before the jaws have been secured to a vehicle portion. Different types of connectors, other than the ring connector 100 and loop tightener 120 can be employed to facilitate the connection of a straightening device to the clamp. As illustrated, each jaw element advantageously comprises a step 20 proximate the hinge connection.

Figure 2:
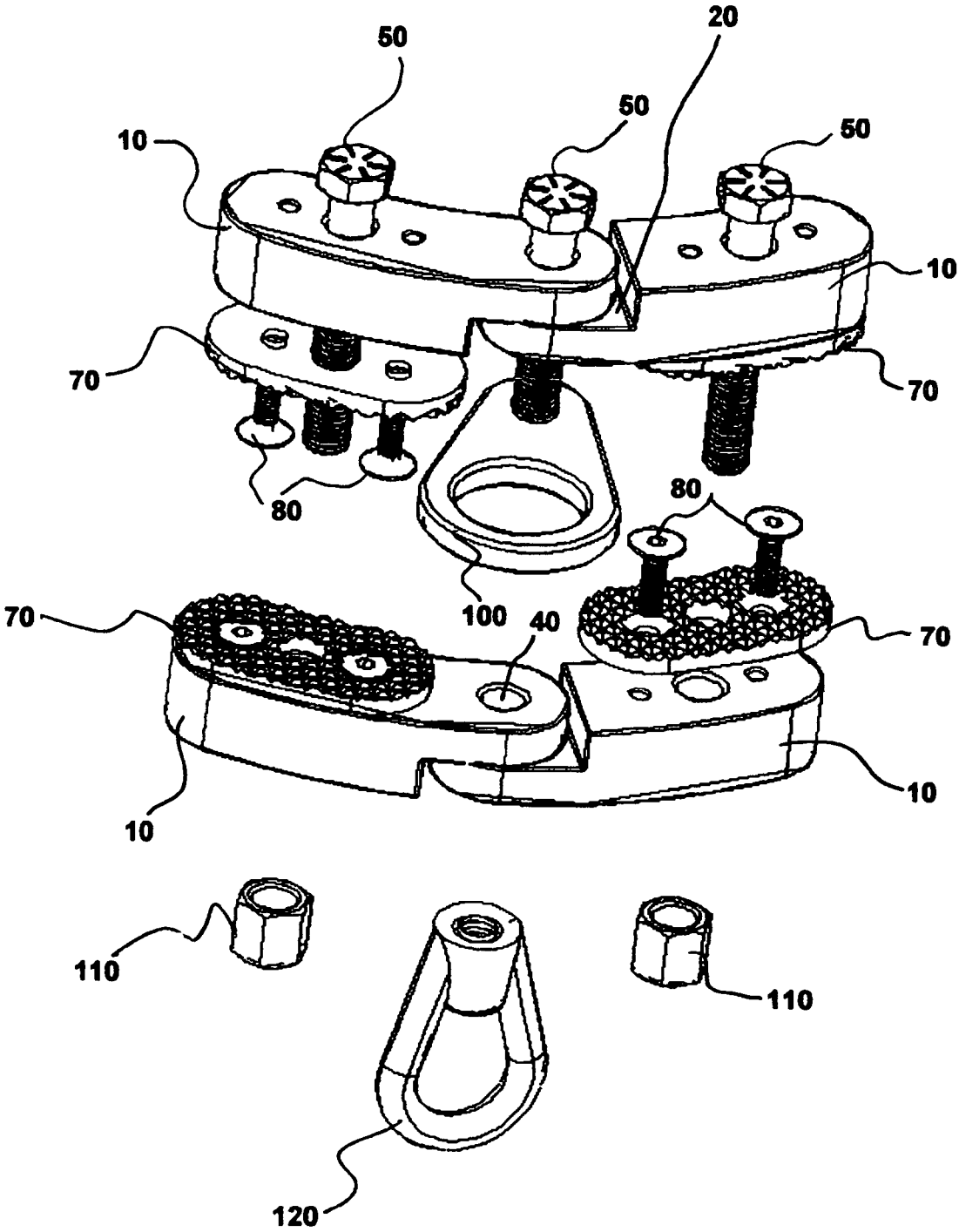
FIG. 2 is a bottom exploded view of the clamp shown in FIG. 1.
Figure 3:
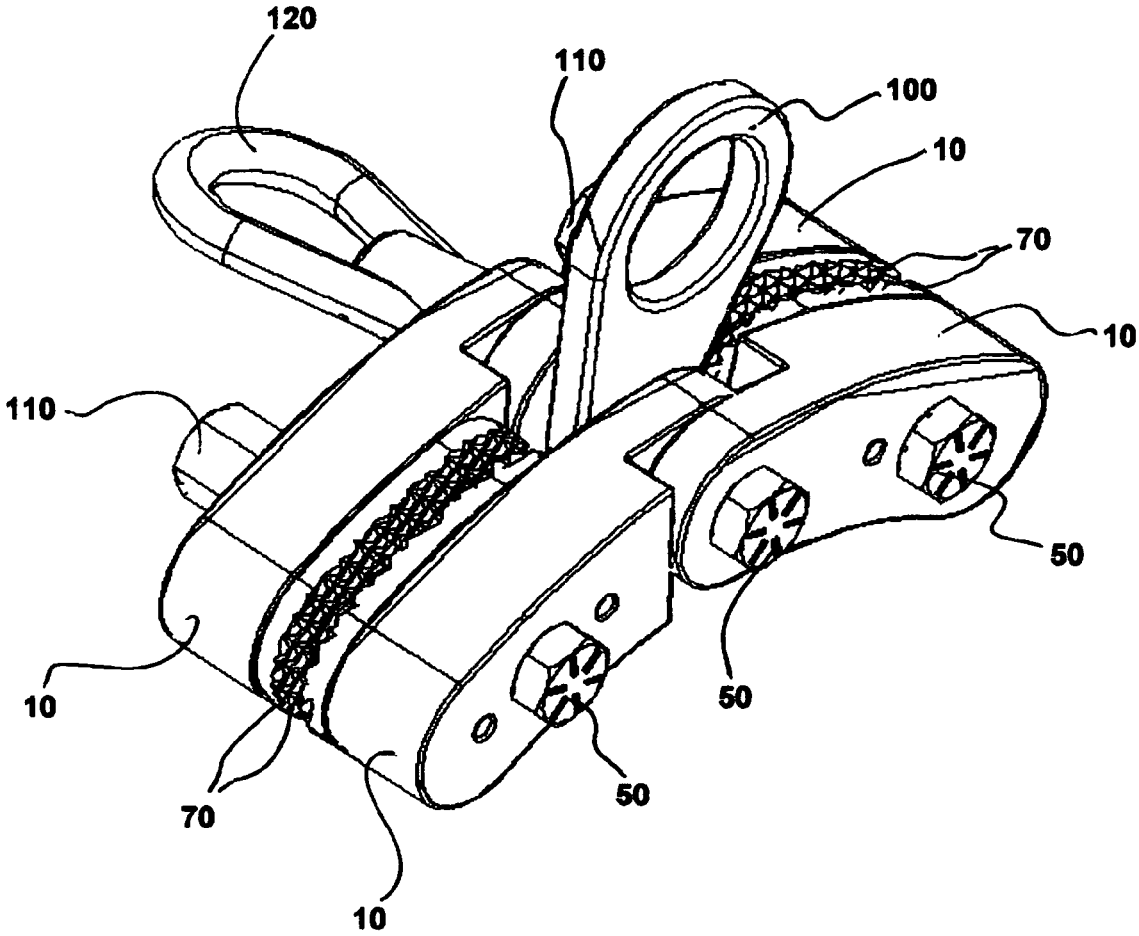
FIG. 3 is a top perspective view of the clamp shown in FIG. 1.
Figure 4:
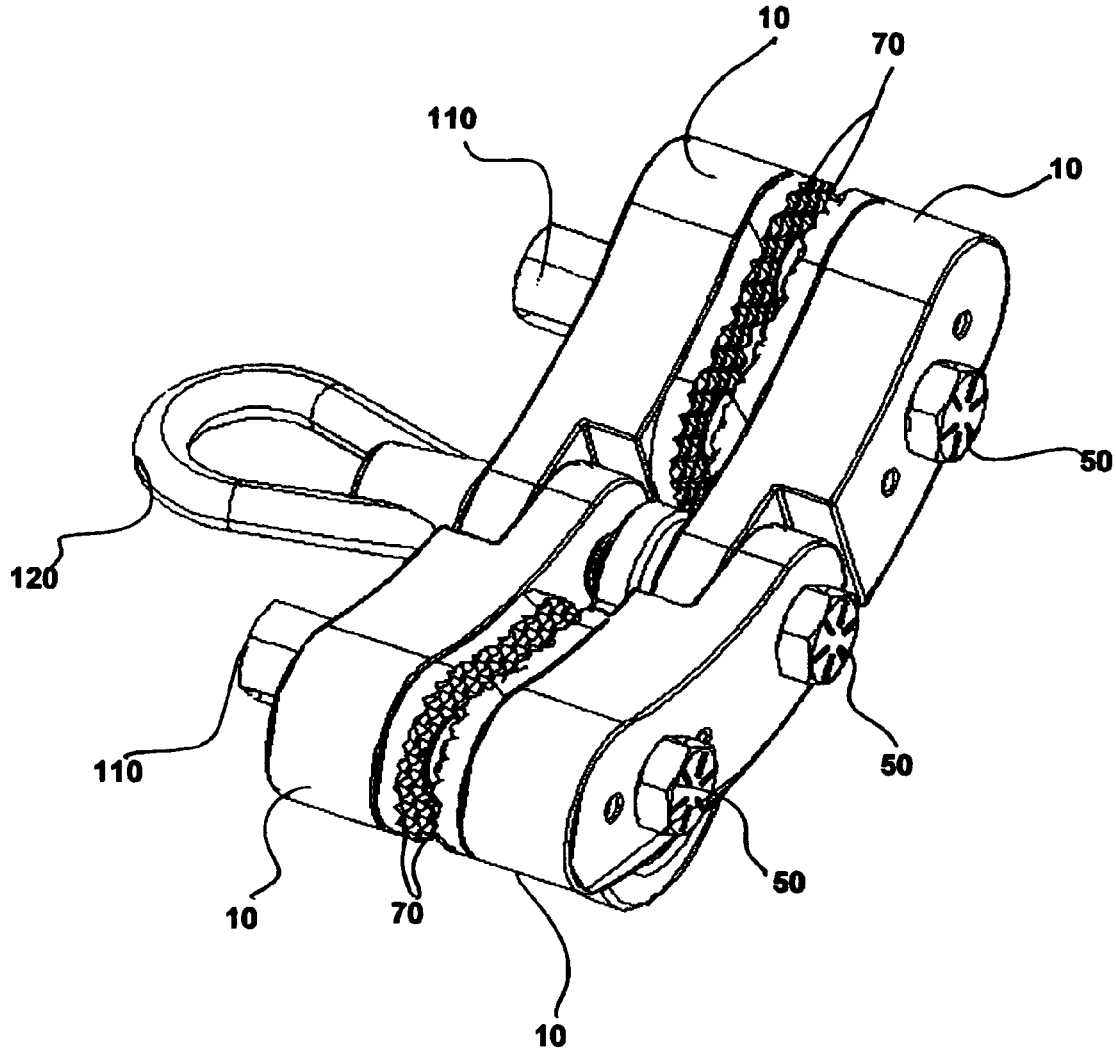
FIG. 4 is a bottom perspective view of the clamp shown in FIG. 1.
Figure 5:
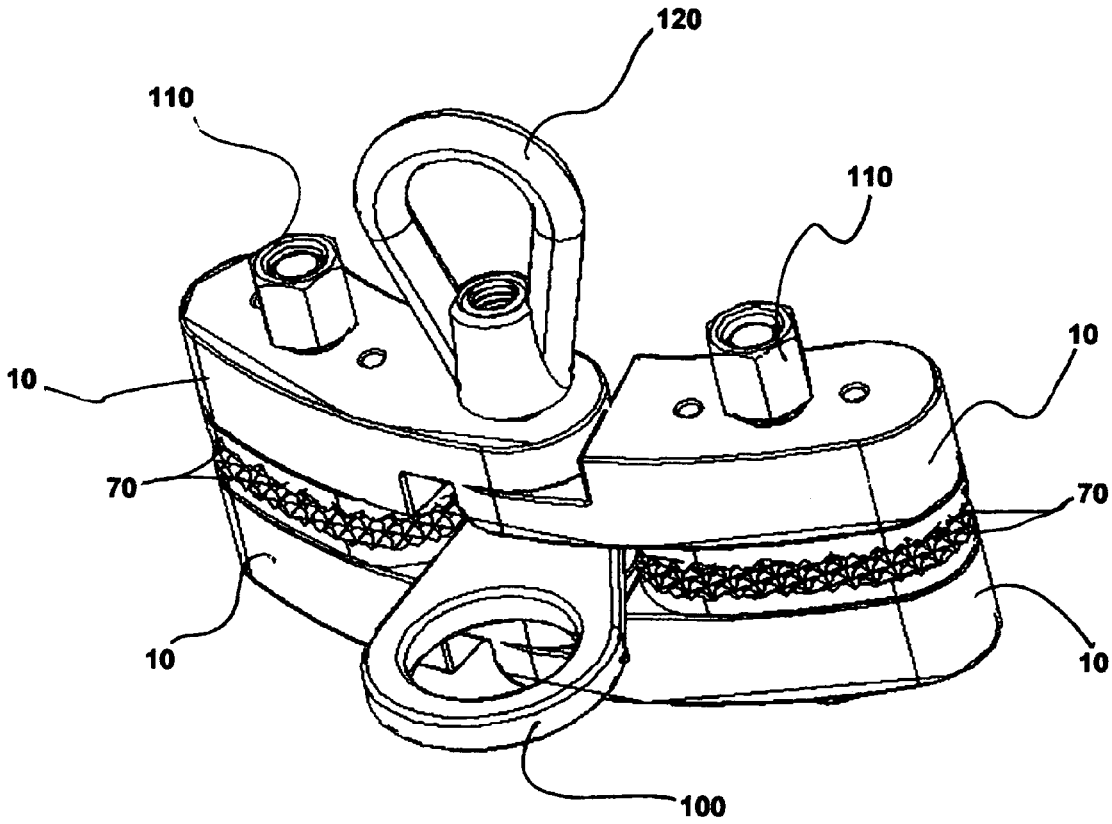
FIG. 5 is a side perspective view of the clamp shown in FIG. 1.

FIG. 2 is an exploded perspective view of the clamp shown in FIG. 1. This view illustrates another advantage of this embodiment wherein each clamp segment 10 is identically shaped. From this description, those skilled in the art will appreciate that forming the clamp segments in identical shapes facilitates replacement and ease of manufacturing. FIGS. 3–5 illustrate the clamps shown in FIGS. 1 and 2 in assembled configurations.

Figure 6:
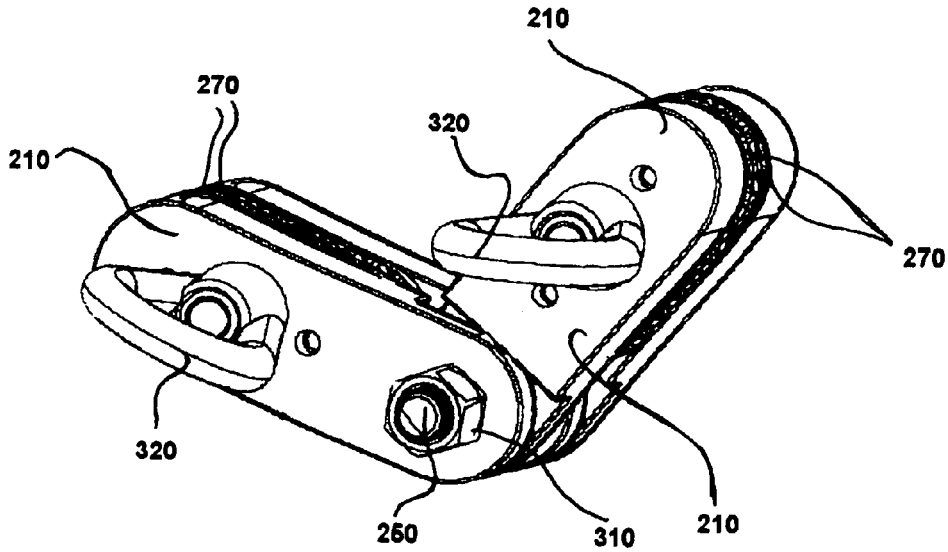
FIG. 6 is a side perspective view of an alternative embodiment of the present invention.
Figure 7:
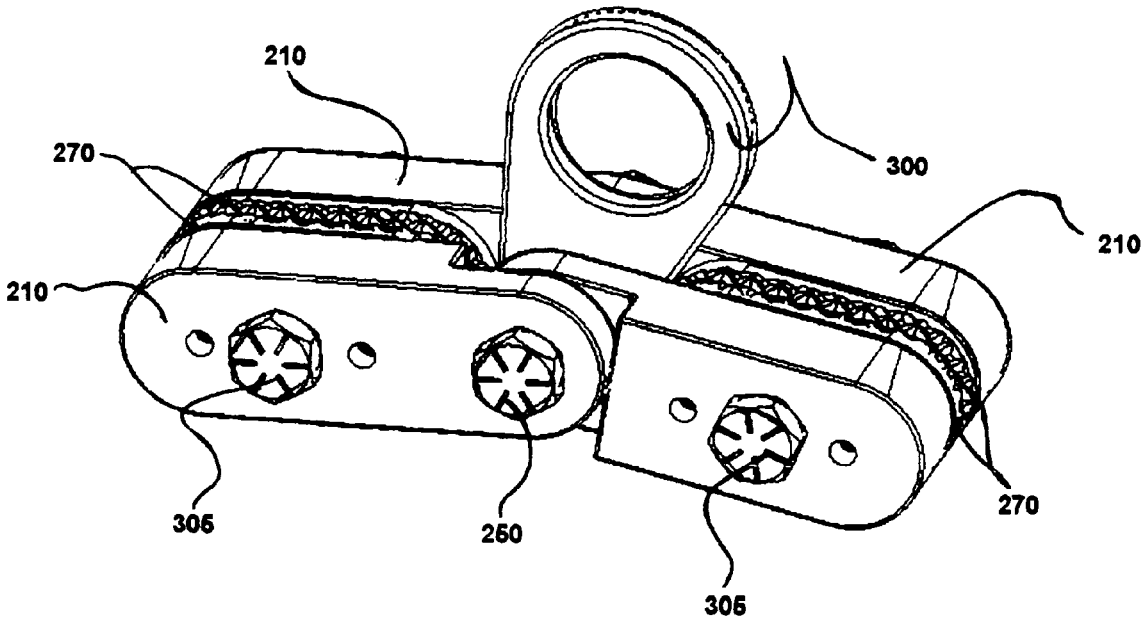
FIG. 7 is a perspective side view of the embodiment shown in FIG. 6 with a ring connector and loop tighteners.

FIGS. 6 and 7 illustrate an alternative embodiment of the present invention wherein jaw segments 210 are relatively straight, as opposed to the non-linear shape of jaw elements 10 shown in FIGS. 1–5. In other respects, the clamps shown in FIGS. 6 and 7 are similar to the clamps shown in FIGS. 1–5, in that a pair of jaw segments 210 are hingedly connected. In the embodiment of FIGS. 6 and 7, the hinge is formed by a bolt 250 secured with a nut 310 and loop tighteners 320 are used to tighten bolts 305. This embodiment also comprises a ring connector 300 and clamp pads 270 secured to jaw segments 210 by removable fasteners.

Figure 8:
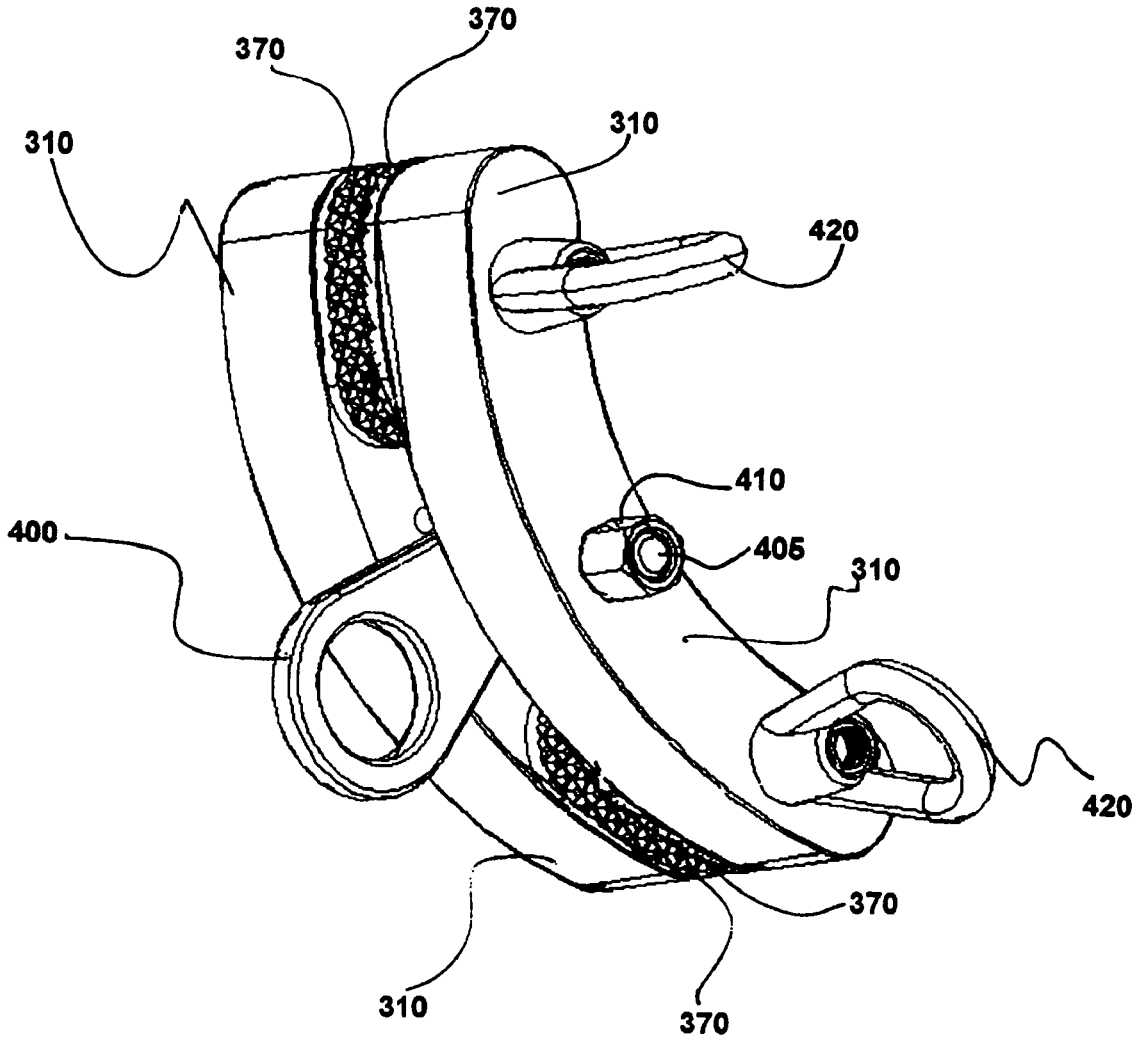
FIG. 8 is a top, perspective view of an alternative embodiment of the present invention comprising arcuate jaws.
Figure 9:
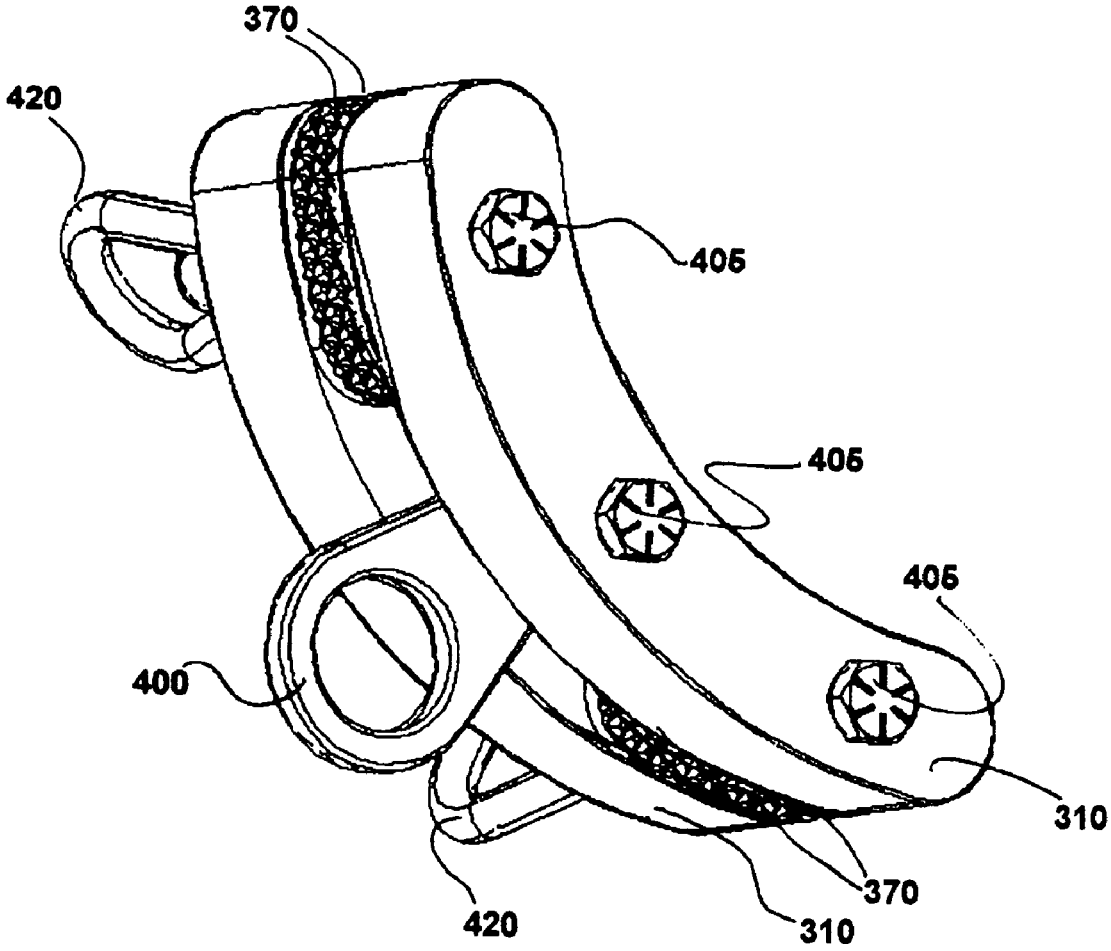
FIG. 9 is a bottom, perspective view of the embodiment shown in FIG. 8.

An alternative embodiment of the present invention is illustrated in FIG. 8 wherein a clamp has two unitary jaws 310. Each jaw 310 has an arcuate shape. While the illustrated jaws 310 pass through an arc of about 70°, the jaws of this embodiment of the present invention can pass through a greater or lesser arc and can have greater or lesser radii of curvature. Jaws of the type shown in FIG. 8 or other jaws of the present invention can be formed with most, if not all, curves or other non-linear shapes typically encountered in vehicle repair. As noted above, connector ring 400 can be disposed on the outside of the curvature as illustrated in FIG. 8 or can be positioned on the opposite side, i.e., inside, of the curvature if desired. FIG. 9 is a bottom perspective view of the clamp showed in FIG. 8. Other elements shown in FIGS. 8 and 9 are similar to elements discussed above including clamp pads 370, ring connector 400, loop tighteners 420, throughbolt 405 and tightening nut 410.

Figure 10:
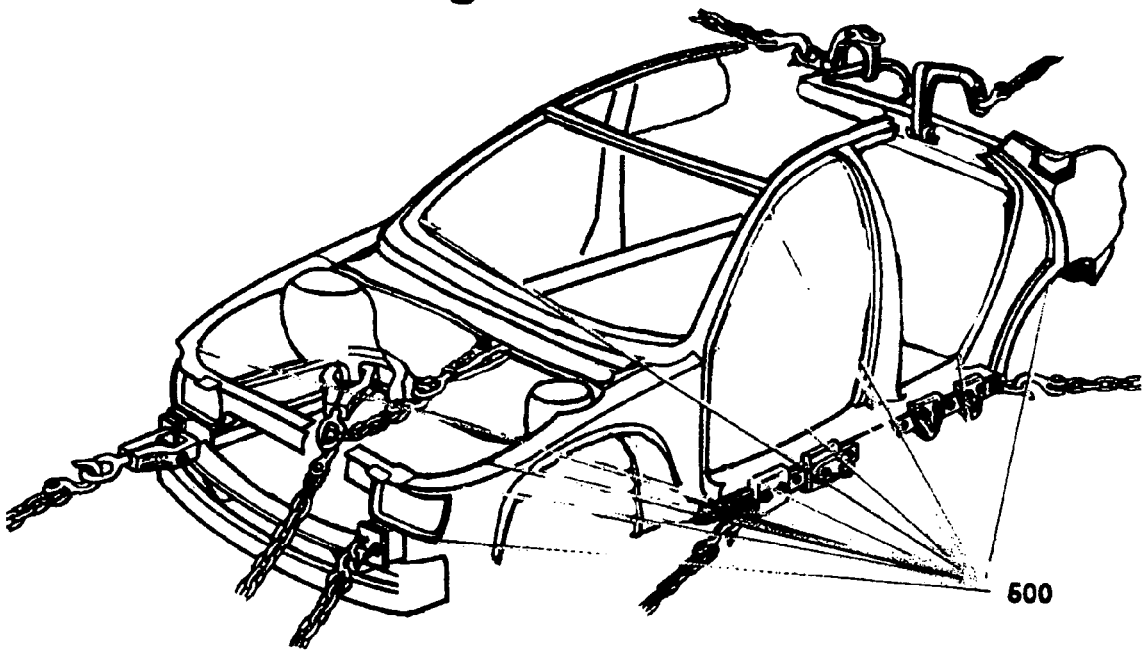
FIG. 10 is a diagram illustrating positions on a vehicle where various embodiments of the present invention may be particularly useful.

FIG. 10 is a diagram illustrating positions 500 on a vehicle where various embodiments of the present invention may be particularly useful.

While the illustrated, non-linear jaws and jaw segments shown in the drawings are generally arcuate, it is also within the scope of the present invention to have other non-linear jaw configurations.

Thus the various embodiments of the present invention provide clamps for vehicle repair which are designed to more closely follow the contour of a non-linear portion of the vehicle being repaired. The arcuate shape of jaw and/or jaw segments can provide a greater gripping surface for angled and/or curved portions of a vehicle. Additionally, the hinge connection between jaw segments provides a technician with the ability to change the relative positions of the jaw segments to either increase or decrease the angle in which they are connected in order to maximize the effective clamping surface area of the clamp on the vehicle.

The invention claimed is:

1. A clamp for connecting a force exerting device to a non-linear portion of a vehicle for performing vehicle repair, comprising:

a plurality of relatively movable jaws and means for tightening said jaws on a portion of a vehicle;

at least one of said jaws comprising a plurality of relatively rotatable, selectively positionable clamp segments whereby said clamp segments can be rotatably positioned relative to each other to optimally conform to a non-linear portion of a vehicle, said at least one law also comprising means for connecting one of said clamp segments to another clamp segment; and means for releasably attaching said jaws to a force exerting device.

2. A clamp according to claim 1 wherein said connecting means comprises a hinged connector.

3. A clamp according to claim 2 wherein said hinged connector comprises a bolt passing through a portion of at least one of said segments.

4. A clamp according to claim 3 wherein said clamp segments comprise a step.

5. A clamp according to claim 4 wherein said steps are disposed in overlapping relation and said hinge connector extends through said overlapping portions of said clamp segments.

6. A clamp according to claim 1 wherein said clamp segments comprise a step.

7. A clamp according to claim 6 wherein said steps are disposed in overlapping relation and said hinge connector extends though said overlapping portions of said clamp segments.

8. A clamp according to claim 1 comprising clamp pads and means for removably connecting said clamp pads to said clamp segments.

9. A clamp according to claim 1 comprising clamp pads comprising a knurled surface on at least one side.

10. A clamp according to claim 1 wherein said clamp segments comprise at least one knurled surface.

11. A clamp according to claim 1 wherein at least one of said clamp segments comprises an arcuate gripping portion.

12. A clamp according to claim 1 wherein at least one of said clamp segments comprises a non-linear gripping portion.

13. A clamp according to claim 1 wherein at least a plurality of jaw segments comprise non-linear gripping portion.

14. A clamp according to claim 1 wherein at least one of said jaw segments comprises a non-linear gripping portion.

15. A clamp according to claim 1 wherein each of the jaw segments comprises a non-linear gripping portion.

16. A clamp according to claim 1 wherein at least one of said clamp segments comprises a linear gripping portion.

17. A clamp according to claim 1 wherein a plurality of jaw segments comprise a linear gripping portion.

18. A clamp according to claim 1 wherein said jaw segments comprise a linear gripping portion.

19. A clamp according to claim 1 wherein all of the jaw segments comprise a linear gripping portion.

20. A clamp for connecting a force exerting device to a curved portion of a vehicle for performing vehicle repair, comprising:

a plurality of relatively movable, non-linear jaws, said jaws comprising elongated, non-linear gripping portions, and means for selectively tightening said jaws on a portion of a vehicle; and means for connecting said jaws to a force exerting device.

21. A clamp according to claim 20 comprising clamp pads and means for removably connecting said clamp pads to said clamp segments.

22. A clamp according to claim 20 comprising clamp pads comprising a knurled surface on at least one side.

23. A clamp according to claim 20 wherein said jaws comprise at least one knurled surface.

* * * * *